United States Patent [19]

Ogasawara et al.

[11] Patent Number: 4,695,763

[45] Date of Patent: Sep. 22, 1987

[54] REFLECTOR TYPE FLUORESCENT LAMP FOR OPTICAL APPARATUS

[75] Inventors: Toshitaka Ogasawara; Kazumasa Nohmi, both of Takatsuki; Masao Honmoh, Bizen; Yukito Iseki, Takatsuki, all of Japan

[73] Assignee: Matsushita Electronics Corporation, Kadoma, Japan

[21] Appl. No.: 788,483

[22] Filed: Oct. 17, 1985

[30] Foreign Application Priority Data

Oct. 18, 1984 [JP] Japan ..... 59-220010

[51] Int. Cl.[4] ..... H01J 61/35; H01J 61/44

[52] U.S. Cl. ..... 313/487; 313/488; 355/67

[58] Field of Search ..... 313/485, 488, 489, 486, 313/487, 113; 355/67, 68

[56] References Cited

U.S. PATENT DOCUMENTS 3,115,309 12/1963 Spencer et al. ..... 313/488 X
3,442,582 5/1969 Lahr ..... 353/29
4,255,687 3/1981 Van Engelen et al. ..... 313/488

FOREIGN PATENT DOCUMENTS 2707109 7/1986 Fed. Rep. of Germany .

*Primary Examiner*—David K. Moore
*Assistant Examiner*—K. Wieder
*Attorney, Agent, or Firm*—Cushman, Darby & Cushman

[57] ABSTRACT

A reflector type fluorescent lamp for use in an optical apparatus, such as a copying machine, has stripe shaped main aperture 3 and narrow stripe shaped sub-aperture 4, wherein the main aperture 3 has no reflective layer 5 and no phsophor layer 6, and the sub-aperture 4 has the phosphor layer 6; the light emitted from main aperture is used to illuminate a document to be copied and another light emitted from the sub-aperture 4 is used to erase electric charge on a photosensitive material drum.

3 Claims, 4 Drawing Figures

REFLECTOR TYPE FLUORESCENT LAMP FOR OPTICAL APPARATUS

BACKGROUND OF THE INVENTION

1. FIELD OF THE INVENTION

The present invention relates generally to a fluorescent lamp, and particularly concerns a reflector type fluorescent lamp for optical apparatus such as a copying machine.

2. DESCRIPTION OF THE PRIOR ART

In recent years, fluorescent lamps are becoming to be used widely, not only for general purpose illumination source but also for light sources of various optical apparatuses. When the fluorescent lamp is used for the optical apparatus, since the area of the object to be illuminated by the fluorescent lamp is narrow in width, it is general that the illumination is controlled such that luminous intensity distribution of the fluorescent lamp is directed to one direction necessary for that purpose by converging the luminous flux. As one conventional example of controlling the luminous intensity distribution by the fluorescent lamp itself, a reflector type fluorescent lamp has been known, wherein reflection film is formed on the inside wall of the glass tube to make a certain angle with respect to its axis thereby forming a wide stripe shaped aperture and a fluoresceent layer is formed only on the reflection layer, or on the reflection layer and on the aperture region.

In order to improve illuminance on the object of the illumination, another constitution of reflector type fluorescent lamp has been proposed in the U.S. Pat. No. 3,442,582, wherein a reflection layer having two stripe shaped apertures of a larger angle and smaller angle with respect to axis of the lamp tube, and a fluorescent layer is formed only on the reflective layer, the two apertures being disposed opposite with respect to the axis, and the lamp tube is used by disposing one of the stripe shaped apertures onto the object to be illuminated and light reflected by the object is taken out through the other stripe shaped aperture.

The fluorescent lamp of the former art has a problem that when used as a light source for an optical apparatus such as the copying machine, a single fluorescent lamp of that type cannot serve both to illuminate the object document to be copied and to illuminate a drum of photosensitive material as an erasing lamp to erase electric charge at the same time, since the lamp tube has only one light emitting aperture and transmittance of light at the part of the reflector is very low in comparison with the aperture part. And the latter lamp tube also has a problem that the light illuminating the document to be copied is lowered due to light emissiion from two apertures since there are two apertures which have no fluorescent layer. Accordingly for each of the above-mentioned prior art fluorescent lamps, there is a necessity of an additional lamp, for instance, a cold cathode discharge lamp which is other than the above-mentioned main fluorescent lamp as the erasing lamp. And for such additional lamp there is a necessity of additional spaces and lamp circuit therefor, and as a result, the miniaturization of the optical apparatus or designing of a small power consumption apparatus is not provided thereby.

OBJECT AND SUMMARY OF THE INVENTION

Accordingly, the purpose of the present invention is to provide a reflector type fluorescent lamp for optical apparatus with which illumination on the document as well as illumination for erasing charges on a photosensitive material drum can be made at the same time with a single common fluorescent lamp, thereby enabling miniaturization of the optical apparatus such as a copying machine or designing of a small power consumption apparatus.

Another object of the present invention is to provide a reflector type fluorescent lamp for optical apparatus wherein light output for illuminating a document to be copied is appropriately controlled.

A reflector type fluorescent lamp for optical apparatus in accordance with the present invention comprises:

a glass tube, a pair of electrode sealed in the glass tube at respective ends thereof, a specified amount of rare gas and mercury, a reflective layer formed on the inner wall of the glass tube in a configuration to have a main aperture making specified angle to axis of the glass tube and a sub-aperture making a narrower angle to the axis and a fluorescent layer formed on the reflective layer and on the sub-aperture.

DESCRIPTION OF THE PREFERRED EMBODIMENTS

Figure 1:
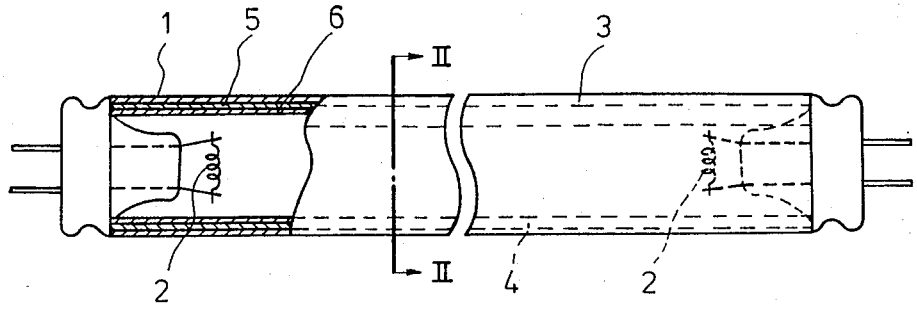
FIG. 1 is a cross-sectional front view of a reflector type fluorescent lamp for optical apparatus embodying the present invention.

The reflector type fluorescent lamp in accordance with the present invention comprises a glass tube 1 and a pair of electrodes 2, 2 which are airtightly sealed in the glass tube 1 at both ends thereof, known rare gas and known small amount of mercury, a reflective layer 5 formed on the inner wall of the glass tube 1 except two stripe-shaped aperture parts, namely, a main aperture 3 and a sub-aperture 4, and a fluorescent layer 6 formed on the reflective layer 5 and on the sub-aperture 4. The main aperture 3 and the sub-aperture 4 are making a larger angle and a smaller angle respectively on a sectional plane which is perpendicular to the axis of glass tube 1 with respect to the axis.

As mentioned above, the reflector type fluorescent lamp for optical apparatus in accordance with the present invention has reflective layer 5, which is formed except the main aperture 3, the sub-aperture 4, which are independently formed, respectively making specified aperture angles around the axis of the glass tube 1, formed on the inner wall of glass tube 1, and the fluorescent layer 6 which is formed on the reflective layer 5 and on the sub-aperture 4, accordingly, when the fluorescent lamp is used in a copying machine or the like optical apparatus, light output from the main aperture 3 can be used to illuminate a document to be copied and another light output from the sub-aperture 4 can be used to erase electric charge of a photosensitive drum of the apparatus. One important feature of the present invention is that the sub-aperture 4 is coated with the fluorescent layer 6, and thereby the fluorescent layer 6 on the sub-aperture 4 serves as a reflection layer, and thus the light output from the main aperture 3 has sufficient quantity of light for illuminating the document to be copied; in other word, the provision of the sub-aperture 4 does not decrease the quantity of light output from the main aperture 3.

By the above-mentioned constitution and operation of the reflector type fluorescent lamp for optical apparatus, miniaturization and power saving of the optical apparatus such as copying machine can be realized.

EXAMPLE 1

Figure 2:
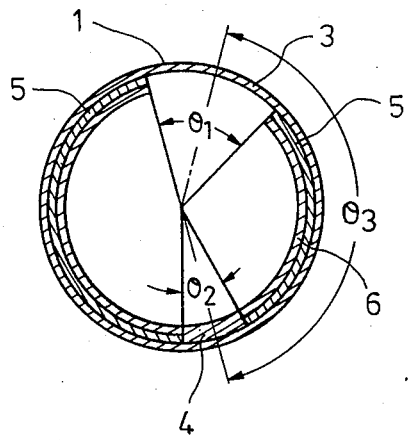
FIG. 2 is an enlarged cross-sectional side view of the same reflector type fluorescent lamp taken on a cross-sectional plane II—II in FIG. 1.

A reflector type fluorescent lamp for optical apparatus having a construction shown in FIG. 1 and FIG. 2 and of 18 watt type is manufactured, wherein glass tube 1 has inner diameter of 14.1 mm, rare gas is Argon of 4.5 Torr, the reflective layer 5 is a layer of white titanium di-oxide powder applied at a rate of 3.8 mg/cm$^2$, the phosphor layer 6 is formed by $CeMgAl_{11}O_{19}:Tb^{3+}$ of phosphor powder applied at a rate of 1.9 mg/cm$^2$, the main aperture 3 is formed to have the aperture angle $\theta_1$ of 60°, the sub-aperture 4 is formed by the sub-aperture angle $\theta_2$ of 25°, the angular disposition of the main aperture 3 and the sub-aperture 4 is such that the centers of the main aperture 3 and the sub-aperture 4 make 150° angle to the axis of the glass tube.

Figure 3:
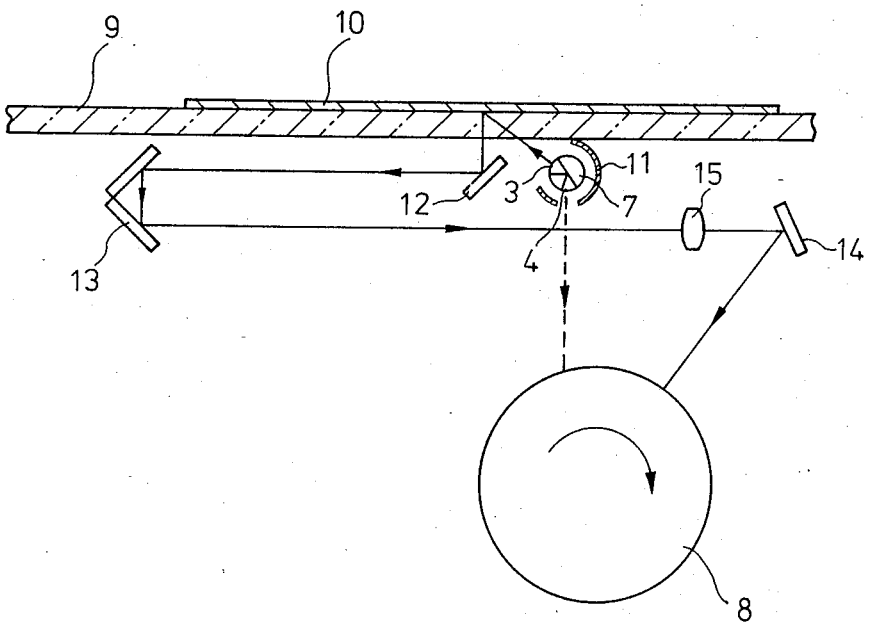
FIG. 3 is an abridged schematic sectional view of a copying machine installed with the same reflector type fluorescent lamp.

The above-mentioned reflector type fluorescent lamp is installed in a copying machine shown in FIG. 3 and the reflector type fluorescent lamp 7 is lit with a lamp current of 0.4 A, whereby light emitted from the main aperture 3 of the lamp 7 is used to illuminate a document to be copied by the copying machine, and the light emitted from the sub-aperture 4 is used to erase electric charge of a drum 8 of photosensitive material. In FIG. 3, which is an abridged sectional view of the copying machine, numeral 9 designate a platen glass and numerals 11, 12, 13 and 14 are reflecting mirrors and numeral 15 is a projection lens.

Figure 4:
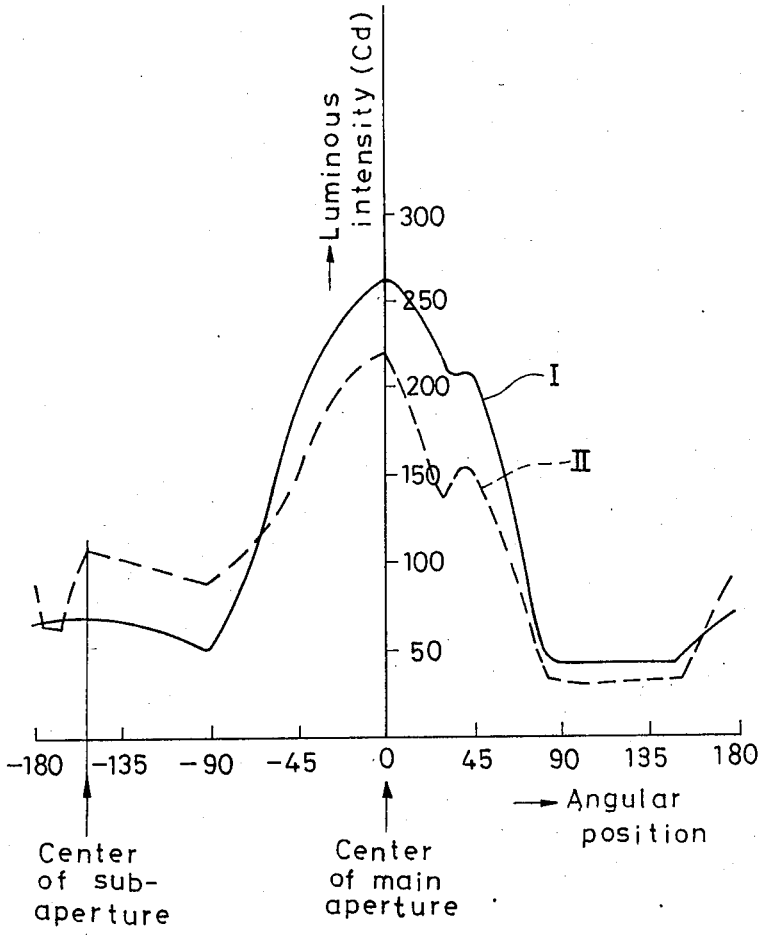
FIG. 4 is a graph showing angular distribution of light intensities of the reflector type fluorescent lamp embodying the present invention and the prior art.

According to the improvement of the present invention, superior advantage has been obtained such that both illuminating for the document to be copied and for erasing electric charge on photosensitive material drum at the same time are performed and thereby a second lamp for the erasing of the photosensitive material drum can be eliminated. Furthermore, as shown by a curve I in FIG. 4, luminous intensity of the light emitted from the main aperture 3 is boosted by 20% in comparison with the conventional lamp shown by a curve II having the same configuration, and electric design except that fluorescent layer is omitted at the sub-aperture. On the other hand lowering of luminous intensity at the sub-aperture does not severely affect the function of the optical apparatus, because only a small light intensity is needed to erase the electric charges on the drum.

Still other advantage of the present invention is that intensity distribution of light emitted from the sub-aperture 4 becomes smooth and uniform by providing the fluorescent layer on the sub-aperture. Therefore, selection freedom of the angle made between center positions of the main aperture and sub-aperture with respect to the axis of the lamp tube, which angles are to accord to positional relation of the optical reading apparatus and photosensitive material drum of a copying machine, can be selected more freely.

Apert from the above-mentioned embodiment where white titanium di-oxide powder is used as the reflective layer 3, a modification may be made such that the reflective layer is formed by coating of a phosphor layer relatively thick, and still other modification may be made for the material of the reflective layer.

Apart from the aforementioned phosphor $CeMgAl_{11}O_{19}$: $Tb^{3+}$, other phosphor materials such as $Zn_2SiO_4:Mn^{2+}$, $BaMg_2Al_{16}O_{27}:Eu^{2+},Mn^{2+}$ or $MgGa_2O_4:Mn^{2+}$ may be similarly used, and there is no limit of kind of phosphors to be used.

Apart from the above-mentioned embodiment wherein angle of main aperture 3 from the axis is 60° and the angle of the sub-aperture 4 axis 25°, in order to make adjustment for sensitivity of photoelectric element of the photoelectric reading apparatus or relative posotion between the lamp and the document to be copied and sensitivity of the photosensitive material drum, the angle of the main aperture from the axis may be 50°–90° and angle of the sub-aperture from the axis may be 10°–40°, to have the same effect, and the angles are not limited to the embodiment.

Apart from the above-mentioned embodiment wherein the relative positional relation between centers of the main aperture 3 and sub-aperture 4 is 150°, mutual angular position of the main aperture 3 and the sub-aperture 4 may be changed apart from the above-mentioned embodiment.

Still furthermore, a metal oxide layer which is transparent to visible light but has high reflectivity to ultraviolet rays may be formed on the inner wall part of the main aperture 3, for instance by using a solution of tetrabuthyltitanate, ultraviolet light is efficiently confined in the glass tube without wastely coming to the glass of the main aperture 3, and thereby the efficiency of the ultraviolet light is improved to increase the visible light output.

We claim:

1. A reflector type fluorescent lamp for optical apparatus comprising:

a glass tube, a pair of electrodes sealed in said glass tube at respective ends thereof, a specified amount of a rare gas and mercury, a reflective layer formed on the inner wall of said glass tube in a configuration to have a main aperture at an angle of 50°–90° with respect to the axis of said glass tube and a sub-aperture at a narrower angle of 10°–40° with respect to said axis, said main aperture is for emission of light for illumination of an object in an optical reading apparatus and said sub-aperture is for emission of light for erasing a drum of photosensitive material, and a fluorescent layer formed on the reflective layer and on said sub-aperture.

2. A reflector type lamp for optical apparatus comprising:

a glass tube, a pair of electrodes sealed in said glass tube at respective ends thereof, a specified amount of a rare gas and mercury, a reflective layer formed on the inner wall of said glass tube in a configuration to have a main aperture at an angle of 50°–90° with respect to the axis of said glass tube and a sub-aperture at a narrower angle of 10°–40° with respect to said axis, said main aperture is for emission of light for illumination of an object in an optical reading apparatus and said sub-aperture is for emission of light for erasing a drum of photosensitive material, and a fluorescent layer formed on the reflective layer and on said sub-aperture, wherein said fluorescent layer comprises a material selected from the group consisting of $CeMgAl_{11}O_{19}:Tb^{3+}$, $Zn_2SiO_4:Mn^{2+}$, $BaMg_2Al_{16}O_{27}:Eu^{2+},Mn^{2+}$ and $MgGa_2O_4:Mn^{2+}$.

3. A reflector type fluorescent lamp for optical apparatus comprising:

a glass tube, a pair of electrodes sealed in said glass tube at respective ends thereof, a specified amount of a rare gas and mercury, a reflective layer formed on the inner wall of said glass tube in a configuration to have a main aperture at an angle of 50°–90° with respect to the axis of said glass tube and a sub-aperture at a narrower angle of 10°–40° with respect to said axis, said main aperture is for emission of light for illumination of an object in an optical reading apparatus and said sub-aperture is for emission of light for erasing a drum of photosensitive material, and a fluorescent layer formed on the reflective layer and on said sub-aperture, wherein said reflective layer consists essentially of white color titanium di-oxide or phosphor.

* * * * *